US009281558B2

(12) United States Patent
Chen et al.

(10) Patent No.: US 9,281,558 B2
(45) Date of Patent: Mar. 8, 2016

(54) HIGH ISOLATION ELECTROMAGNETIC TRANSMITTER AND RECEIVER

(71) Applicant: SOUTHERN TAIWAN UNIVERSITY OF SCIENCE AND TECHNOLOGY, Tainan (TW)

(72) Inventors: Wen-Shan Chen, Tainan (TW); Ke-Ming Lin, Tainan (TW)

(73) Assignee: Southern Taiwan University of Science and Technology, Tainan (TW)

( * ) Notice: Subject to any disclaimer, the term of this patent is extended or adjusted under 35 U.S.C. 154(b) by 166 days.

(21) Appl. No.: 14/164,488

(22) Filed: Jan. 27, 2014

(65) Prior Publication Data

US 2015/0214612 A1 Jul. 30, 2015

(51) Int. Cl.

| | |
|---|---|
| ***H01Q 1/52*** | (2006.01) |
| *H01Q 9/42* | (2006.01) |
| *H01Q 21/28* | (2006.01) |

(52) U.S. Cl.

CPC ..... *H01Q 1/525* (2013.01); *H01Q 9/42* (2013.01); *H01Q 21/28* (2013.01)

(58) Field of Classification Search

CPC ..... H01Q 1/243; H01Q 1/523; H01Q 1/525; H01Q 21/28; C07D 221/26

USPC ..... 343/702, 850, 835, 833, 834, 841

See application file for complete search history.

(56) References Cited

U.S. PATENT DOCUMENTS

| | | | | |
|---|---|---|---|---|
| 7,525,502 | B2 * | 4/2009 | Hui | H01Q 1/243 343/702 |
| 7,557,761 | B2 * | 7/2009 | Iwai | H01Q 9/30 343/702 |
| 2006/0038736 | A1 * | 2/2006 | Hui | H01Q 1/521 343/835 |
| 2008/0174508 | A1 * | 7/2008 | Iwai | H01Q 9/30 343/850 |
| 2013/0099980 | A1 * | 4/2013 | Hayashi | H01Q 1/48 343/700 MS |
| 2013/0293425 | A1 * | 11/2013 | Zhu | H01Q 1/243 343/702 |

* cited by examiner

*Primary Examiner* — Jean B Jeanglaude
(74) *Attorney, Agent, or Firm* — Rosenberg, Klein & Lee

(57) ABSTRACT

A high isolation electromagnetic transmitter and receiver is revealed. An isolation portion, a first antenna body and a second antenna body are extended from and formed over a grounding portion. The isolation portion is extended to and formed between the first antenna body and the second antenna body. A parasitic element corresponding to the isolation portion is disposed between the first antenna body and the second antenna body. The isolation portion is T-shaped. The parasitic element is reverse T-shaped and arranged over the grounding portion. The structure is simple and able to be applied to the design of planar printed antennas. The production is easy and the cost is reduced. The volume is minimized to be used in various mini wireless mobile communication devices. No interference occurs even that the first and the second antennas are close due to good isolation.

9 Claims, 4 Drawing Sheets

HIGH ISOLATION ELECTROMAGNETIC TRANSMITTER AND RECEIVER

BACKGROUND OF THE INVENTION

1. Fields of the Invention

The present invention relates to an electromagnetic transmitter and receiver, especially to a high isolation electromagnetic transmitter and receiver that has simple structure to be applied to planar printed antennas, easy production, lower cost and compact volume to be used in various mini wireless mobile communication devices.

2. Descriptions of Related Art

In the era of information explosion, the data flow used before doesn't meet requirements of the wireless flow for communication and electronic transmission. Thus the amount of flow the wireless transmission device needs during data transmitting and receiving is increased dramatically and the antenna plays an important role in the wireless transmission device.

Nowadays a multiple-input multiple-output (MIMO) antenna is used to increase the isolation between antennas. Generally, the isolation is improved by increasing the distance between the antennas, or different polarization directions of the antennas. However, the increasing of the distance between the antennas results in that the increasing size of the antenna. As to different polarization directions of the antennas, the space require for the whole antenna needs to be changed.

SUMMARY OF THE INVENTION

Therefore it is a primary object of the present invention to provide a high isolation electromagnetic transmitter and receiver that has a simple structure to be applied to the design of planar printed antennas. Moreover, the production is easy and the cost is reduced. The volume is minimized so that the compact size is able to be used in various mini wireless mobile communication devices. Furthermore, no interference occurs even that the first and the second antennas are close due to good isolation of the device.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
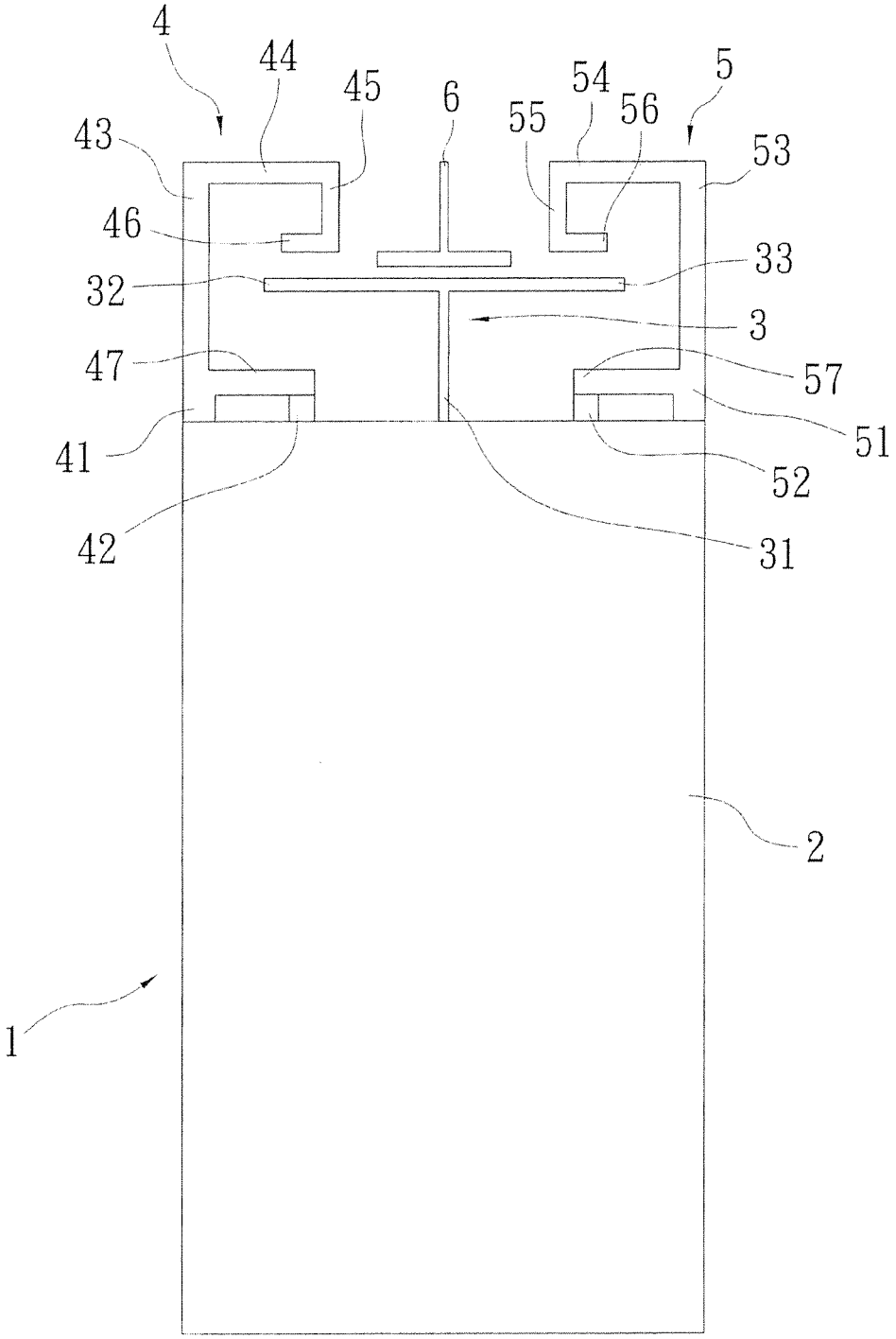
FIG. 1 is a schematic drawing showing structure of an embodiment according to the present invention.

Refer to FIG. 1, the present invention is a multiple-input multiple-output (MIMO) wireless device used for the operation of WLAN (Wireless Local Area Network) 802.11n. The MIMO includes a substrate 1 made from glass fiber with a thickness of 1.6 mm, relative is permittivity of 4.4, and loss tangent of 0.0245. A grounding portion 2 is formed on the substrate 1 while an isolation portion 3, a first antenna body 4 and a second antenna body 5 are extended from and formed over a surface of the substrate 1. The isolation portion 3 is extended to and located between the first antenna body 4 and the second antenna body 5. A parasitic element 6 is disposed between the first antenna body 4 and the second antenna body 5 and is corresponding to the isolation portion 3.

The isolation portion 3 is in a mode of resonance isolation and is composed of a vertical extension segment 31 extended upward from the grounding portion 2, a first horizontal extension segment 32, and a second horizontal extension segment 33. One end of the vertical extension segment 31 away from the grounding portion 2 is extended toward two opposite directions to form the first horizontal extension segment 32 and the second horizontal extension segment 33. Thus the isolation portion 3 is T-shaped.

As to the first and the second antenna bodies 4, 5, the resonance is one-fourth wavelength. A first short circuit segment 41 and a second short circuit segment 51 are extended from the grounding portion 2. A first feed point 42 and a second feed point 52 for feeding signals are arranged adjacent to the grounding portion 2 and are separated from the first short circuit segment 41 and the second short circuit segment 51 respectively. A coaxial line or a monopole antenna is used at the first feed point 42 and the second feed point 52. The first short circuit segment 41 and the second short circuit segment 51 are extended upward to form a first vertical segment 43 and a second vertical segment 53 respectively. The first vertical segment and 43 and the second vertical segment 53 are extended horizontally to form a first horizontal segment 44 and a second horizontal segment 54 respectively. The first horizontal segment 44 and the second horizontal segment 54 are extended toward the grounding portion 2 to form a first branched vertical segment 45 and a second branched vertical segment 55 respectively. The first branched vertical segment 45 and the second branched vertical segment 55 are extended toward the first and the second vertical segments 43, 53 to form a first rear-end segment 46 and a second rear-end segment 56 respectively. There is a certain distance between the first/second rear-end segment 46, 56 and the first/second horizontal extension segment 32, 33. A first feed segment 47 and a second feed segment 57 are extended horizontally between the first short circuit segment 41/the second short circuit segment 51 and the first feed point 42/the second feed point 52.

The parasitic element 6 is disposed over the grounding portion 2 and is a reverse T-shaped. There is a certain distance between the parasitic element 6 and the grounding portion 2. The parasitic element 6 is adjacent to the first antenna body 4 and the second antenna body 5 and there is a certain distance therebetween. The first antenna body 4 and the second antenna body 5 are isolated by inductance capacitance coupling.

Figure 2:
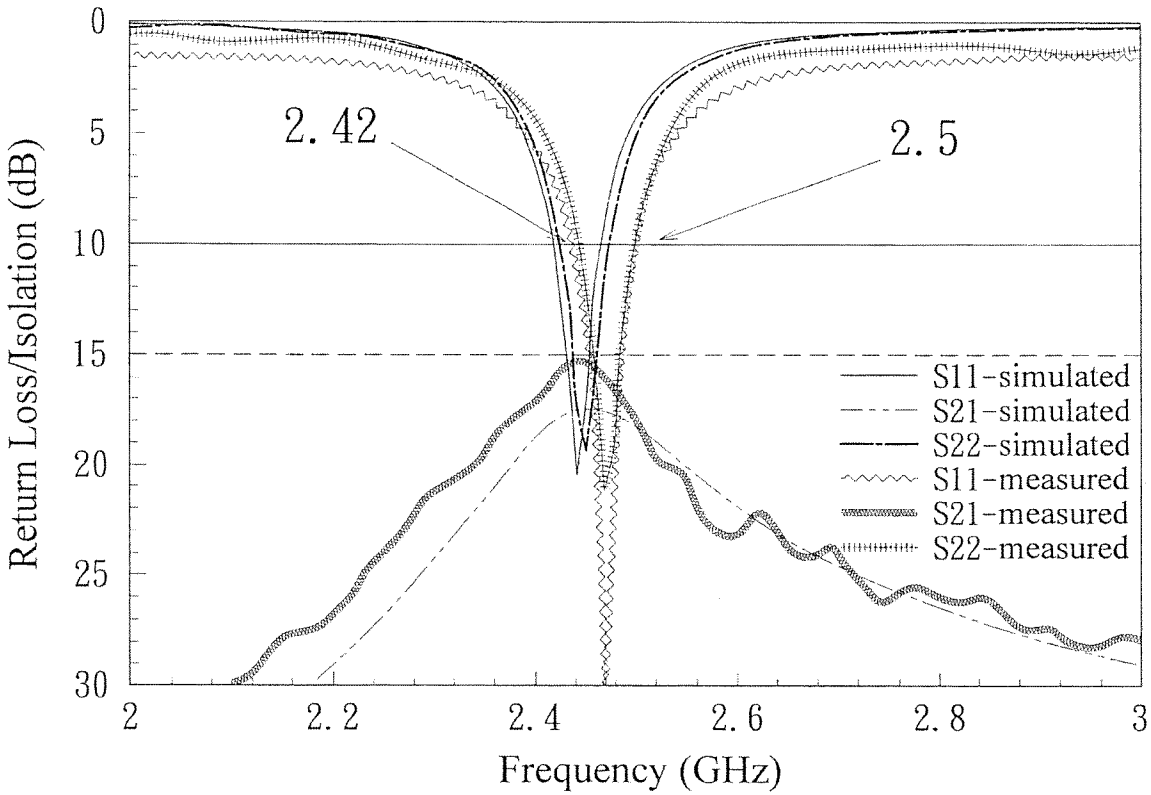
FIG. 2 shows measured and simulated S-parameter data of an embodiment according to the present invention.

Refer to FIG. 2, measured and simulated S parameter data of the antenna according to the present invention are shown. It is learned that the measured results of the antenna of the present invention meet the bandwidth requirement for 2.42 GHz-2.484 GHz WLAN operation. The measured results are quite close to the mode representation of the antenna and it is clear that the mode is excited at 2.42 GHz-2.484 GHz and resonant. By analysis of the mode of S parameter at 2.42 GHz, the phase of the surface current is reversed once the antenna of the present invention provides isolation in the frequency band of interest. That means mutual coupling between the first antenna body 4 and the second antenna body 5 is reduced by addition one T-shaped isolation portion 3 extended from the grounding portion 2 and arrangement of the parasitic element 6. The distance between the T-shaped isolation portion 3 extended from the grounding portion 2 and the first rear-end segment 46 of the first antenna body 4/the second rear-end segment 56 of the second antenna body 5 is 1 mm while the distance between the parasitic element 6 and the T-shaped isolation portion 3 is only 0.4 mm. The mutual coupling between capacitance and inductance is generated to provide the best matching for improving isolation and bandwidth.

Figure 3:
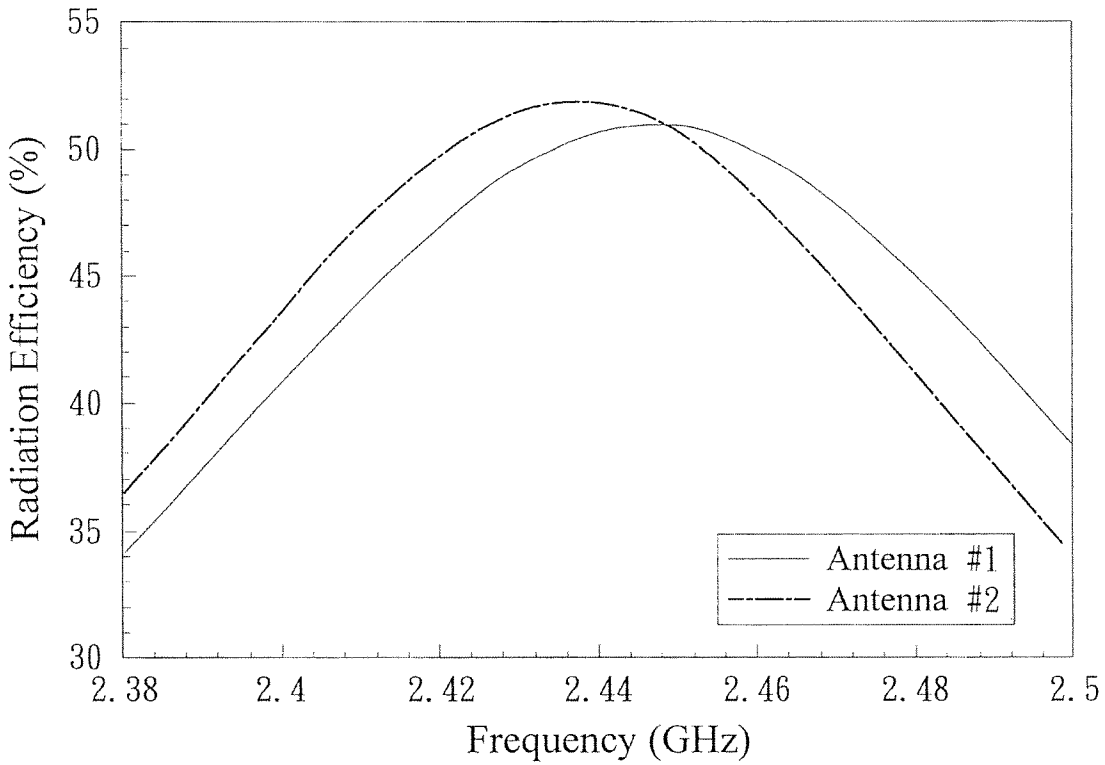
FIG. 3 shows measured radiation efficiency of an antenna of an embodiment according to the present invention.
Figure 4:
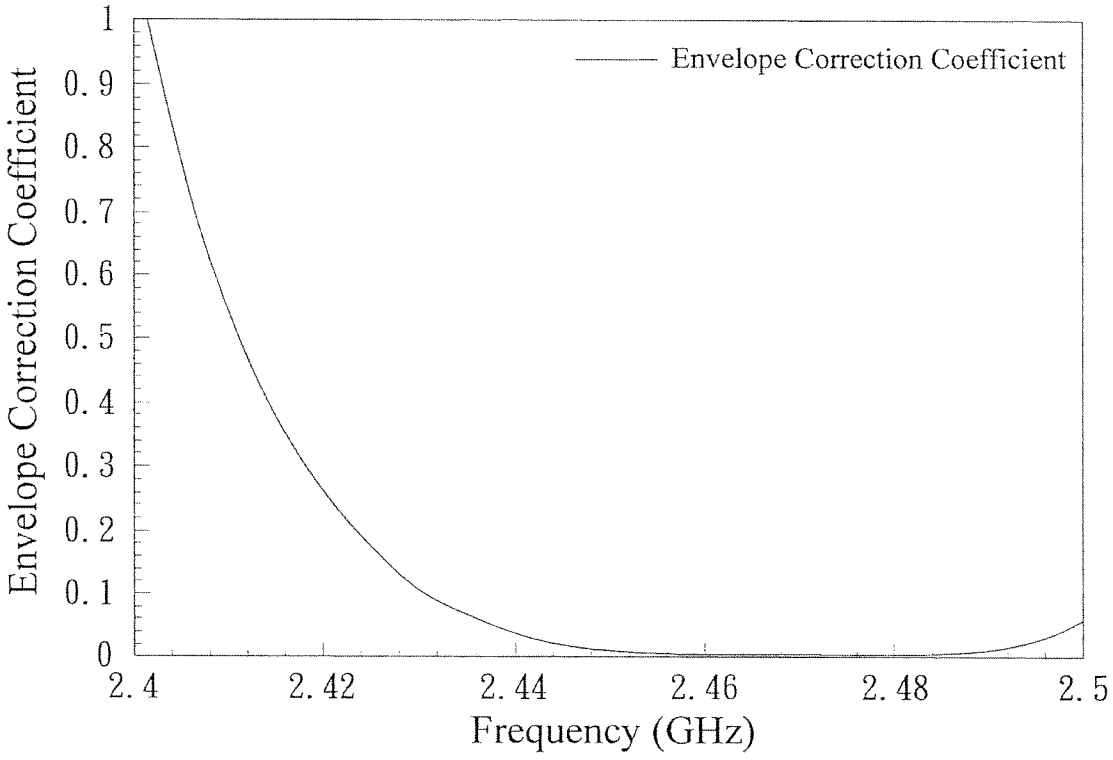
FIG. 4 shows measured data related to envelope correction coefficients of an antenna of an embodiment according to the present invention.

Refer to FIG. 3, measured radiation efficiency of the antenna according to the present invention is revealed. The radiation efficiency of the antenna according to the present invention is over 40%. For small-sized MIMO antenna, such efficiency is acceptable in the field. Refer to FIG. 4, in the operation of IEEE 802.11n, the maximum value of the envelope correction coefficient is 0.3 while the minimum value is about 0.05. Thus the correction coefficient data shows that the antenna of the present invention has good isolation within the present operation band. And the good isolation can also be learned by packet correlation and the diversity gain.

Compared with the structure available now, the present invention has following advantages:

1. The present invention can be applied to the design of planar printed antennas. The production is simple and easy, and the cost is down.
2. The design of the present invention is simplified and more convenient so that the volume of the device is dramatically reduced and is able to be used in various mini wireless mobile communication devices.
3. The antenna of the present invention has good isolation and no active or passive component is required. Good isolation is achieved by adjusting a distance between the first/second antenna body and the parasitic element and there is no interference problem even the first and the second antennas are quite close to each other.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A high isolation electromagnetic transmitter and receiver comprising:

a grounding portion, a first antenna body extended from the grounding portion, a second antenna body extended from the grounding portion, an isolation portion that is extended from the grounding portion and located between the first antenna body and the second antenna body; and a parasitic element that is corresponding to the isolation portion and disposed between the first antenna body and the second antenna body;

wherein the isolation portion includes a vertical extension segment extended upward from the grounding portion; one end of the vertical extension segment away from the grounding portion is extended toward two opposite directions to form a first horizontal extension segment and a second horizontal extension segment; the isolation portion is T-shaped;

the first antenna body is extended from the grounding portion;

the second antenna body is extended from the grounding portion;

the parasitic element is reverse T-shaped and arranged over the grounding portion so as to isolate the first antenna body and the second antenna body;

wherein the first antenna body includes a first short circuit segment extended from the grounding portion, a first feed point for feeding signals arranged adjacent to the grounding portion and separated from the first short circuit segment, a first vertical segment formed by the upward extension of the first short circuit segment, a first horizontal segment formed by horizontal extension of an outer end of the first vertical segment, a first branched vertical segment formed by extension of the first horizontal segment toward the grounding portion, a first rear-end segment formed by extension of the first branched vertical segment toward the first vertical segments, and a first feed segment extended horizontally between the first short circuit segment and the first feed point; the second antenna body includes a second short circuit segment extended from the grounding portion, a second feed point for feeding signals arranged adjacent to the grounding portion and separated from the second short circuit segment, a second vertical segment formed by the upward extension of the second short circuit segment, a second horizontal segment formed by horizontal extension of an outer end of the second vertical segment, a second branched vertical segment formed by extension of the second horizontal segment toward the grounding portion, a second rear-end segment formed by extension of the second branched vertical segment toward the second vertical segments, and a second feed segment extended horizontally between the second short circuit segment and the second feed point.

2. The device as claimed in claim 1, wherein a coaxial line or a monopole antenna is used at the first feed point of the first antenna body and the second feed point of the second antenna body.

3. The device as claimed in claim 1, wherein a distance between the parasitic element and the grounding portion is 0.4 mm.

4. The device as claimed in claim 1, wherein the isolation portion is in a mode of resonance isolation.

5. The device as claimed in claim 1, wherein resonance wavelength of the first antenna body and the second antenna body is one-fourth wavelength.

6. The device as claimed in claim 1, wherein the parasitic element isolates the first antenna body and the second antenna body by inductance capacitance coupling.

7. The device as claimed in claim 1, wherein the grounding portion, the isolation portion, the first antenna body, the second antenna body and the parasitic element are disposed on a substrate.

8. The device as claimed in claim 7, wherein the substrate is made from glass fiber with a thickness of 1.6 mm, relative permittivity of 4.4, and loss tangent of 0.0245.

9. The device as claimed in claim 1, wherein a distance between the first horizontal extension segment of the isolation portion and the first rear-end segment of the first antenna body is 1 mm; a distance between the second horizontal extension segment of the isolation portion and the second rear-end segment of the second antenna body is 1 mm.

* * * * *